US010870528B2

(12) United States Patent
O'Malley

(10) Patent No.: US 10,870,528 B2
(45) Date of Patent: Dec. 22, 2020

(54) PACKAGED INTERLEAVED CURVED EDGE CIGARETTE ROLLING PAPERS

(71) Applicant: Curved Papers, Inc., Plainview, NY (US)

(72) Inventor: Michael O'Malley, Plainview, NY (US)

(73) Assignee: CURVED PAPERS, INC., Plainview, NY (US)

( * ) Notice: Subject to any disclaimer, the term of this patent is extended or adjusted under 35 U.S.C. 154(b) by 57 days.

(21) Appl. No.: 16/171,125

(22) Filed: Oct. 25, 2018

(65) Prior Publication Data

US 2019/0168953 A1 Jun. 6, 2019

Related U.S. Application Data

(63) Continuation-in-part of application No. 15/276,415, filed on Sep. 26, 2016, now Pat. No. 10,165,795, which is a continuation-in-part of application No. 14/278,030, filed on May 15, 2014, now abandoned.

(60) Provisional application No. 62/577,580, filed on Oct. 26, 2017, provisional application No. 61/976,036, filed on Apr. 7, 2014.

(51) Int. Cl.

| | |
|---|---|
| ***A24F 1/02*** | (2006.01) |
| ***B65D 83/08*** | (2006.01) |
| ***A24D 1/02*** | (2006.01) |

(52) U.S. Cl.

CPC ..... *B65D 83/0894* (2013.01); *A24D 1/022* (2013.01); *A24D 1/025* (2013.01)

(58) Field of Classification Search

None

See application file for complete search history.

(56) References Cited

U.S. PATENT DOCUMENTS

| | | | |
|---|---|---|---|
| 1,289,975 | A | 12/1918 | Waddell |
| 1,363,989 | A | 12/1920 | Morley |
| 4,114,629 | A | 9/1978 | Sedlacek et al. |
| 5,060,675 | A | 10/1991 | Milford et al. |
| 5,450,862 | A | 9/1995 | Baldwin et al. |
| 5,505,109 | A | 4/1996 | Okonski et al. |
| 5,878,754 | A | 3/1999 | Peterson et al. |

(Continued)

FOREIGN PATENT DOCUMENTS

| | | |
|---|---|---|
| DE | 819219 | 10/1951 |
| DE | 202004019112 | 4/2006 |

(Continued)

OTHER PUBLICATIONS

International Search Report and Written Opinion for International Stage PCT/US2015/023464 dated Jul. 15, 2015.

(Continued)

*Primary Examiner* — Dennis R Cordray

(74) *Attorney, Agent, or Firm* — Keusey & Associates, P.C.

(57) ABSTRACT

A pop-up dispenser is provided containing a stack of curved edge cigarette rolling papers. The papers are folded and interleaved within a box having a slot for dispensing one curved edge cigarette rolling paper at a time. A cover hinged to one edge of the box overlies the slot in the closed position. One paper is dispensed with its straight edge exiting the box first followed by a subsequent paper dispensed with its curved edge exiting the box first.

11 Claims, 5 Drawing Sheets

(56) References Cited

U.S. PATENT DOCUMENTS

| | | | | |
|---|---|---|---|---|
| 6,138,684 | A | 10/2000 | Yamazaki et al. | |
| 8,701,681 | B2 | 4/2014 | Rasouli et al. | |
| 9,072,319 | B2 * | 7/2015 | Kesselman | A24D 1/02 |
| 2008/0308431 | A1 * | 12/2008 | Kesselmann | A24F 17/00 206/237 |
| 2009/0099869 | A1 | 4/2009 | Darin et al. | |
| 2010/0059538 | A1 | 3/2010 | Van De Perre | |
| 2011/0030710 | A1 | 2/2011 | Kesselman | |

FOREIGN PATENT DOCUMENTS

| | | | |
|---|---|---|---|
| EP | 978462 | A1 * | 2/2000 |
| FR | 620791 | | 4/1927 |
| FR | 1109547 | | 1/1956 |
| GB | 18827 | | 12/1912 |

OTHER PUBLICATIONS

"Rolling Paper Sizes", Rolling Paper Warehouse, 2015, [online], retrieved from the Internet, [retrieved Dec. 30, 2015], <URL: http://www.rollingpaperwarehouse.com/ROLLING-PAPER-SIZES_ep_45.html>.

Translation of FR 620791 A, European Patent Office and Google, [ online ], retrieved from the Internet, [ retrieved Mar. 16, 2018], <URL: https:/ /worldwide.espacenet.com/?locale~ EN_ ep>.

International Preliminary Report on Patentability for International Stage PCT/US2015/023464 dated Oct. 12, 2016.

* cited by examiner

PACKAGED INTERLEAVED CURVED EDGE CIGARETTE ROLLING PAPERS

CROSS-REFERENCE TO RELATED APPLICATIONS

This application claims the benefit under 35 U.S.C. § 119(e) from U.S. Provisional Patent Application No. 62/577,580 entitled PACKAGED INTERLEAVED CURVED EDGE CIGARETTE PAPERS filed Oct. 26, 2017.

This application is a continuation-in-part of co-pending U.S. patent application Ser. No. 15/276,415 entitled METHOD FOR MANUFACTURING CURVED EDGE CIGARETTE ROLLING PAPERS filed Sep. 26, 2016, which is a continuation-in-part of U.S. patent application Ser. No. 14/278,030 entitled EASY TO ROLL CURVED EDGE CIGARETTE ROLLING PAPER filed May 15, 2014, which claims the benefit under 35 U.S.C. § 119(e) from U.S. Provisional Patent Application No. 61/976,036 entitled EASY TO ROLL CURVED EDGE CIGARETTE ROLLING PAPER filed Apr. 7, 2014.

BACKGROUND OF THE INVENTION

1. Field of the Invention

The invention is related to novel curved edge cigarette rolling papers which are interleaved and packaged in a form that is familiar and convenient to the consumer.

2. The Prior Art

Most rolling papers are sold in an interleaved format, introduced first by Zig-Zag in 1900. The current application is directed to a package containing easy to roll curved edge rolling papers in an interleaved format.

The common sizes are called 1¼s and King Size Slim. But these packages can vary in size and contain rolling papers of various materials. The easy to roll curved edge invention and the invention of packaging them in an interleaved format can be applied to different types of paper at various sizes.

Various attempts have been made to improve the packaging of rolling papers, for example, U.S. Published Patent Application 2010/0059538 entitled ROLLING PAPER BOOKLET FOR CIGARETTES. The patent application discloses an interleaved stack of rolling papers where the adhesive is alternately provided on the upper folding part and the lower folding part. In addition the application shows a package with two stacks of papers which are dispensed through two respective slits in the top panel of the package.

An improvement in adhesive is shown in U.S. Published Patent Application 2011/0030710 entitled ROLLING PAPER STRUCTURES FOR CREATING SMOKING ARTICLES AND ADHESIVES COMPRISING HEMP ADDITIVE FOR SAME. The application discloses suspending hemp powder in water and mixing it with an adhesive solution which is then applied along two adjacent edges of the rolling paper. The rolling paper is then provided with an off-center fold with a short section opposite the sealing edge adhesive.

It would be desirable to provide an interleaved package with an improved rolling paper design.

Accordingly, it is an object of the present invention to provide curved edge cigarette rolling papers that are interleaved in an easy to dispense package.

SUMMARY OF THE INVENTION

It is therefore an object of the invention to provide curved edge cigarette rolling papers in an easy to use package or booklet.

It is a further object to arrange the curved edge cigarette rolling papers in a stack within the package.

It is another object to dispense the curved edge cigarette rolling papers with the curved edge leading alternating with the rectilinear edge leading.

It is a further object to provide adhesive on the rectilinear edge of the rolling papers.

It is another object to provide the container lid with the same shape and size curve as the curved edge of the rolling paper.

These and other related objects are achieved by a pop-up dispenser for curved edge cigarette rolling papers having a stack of papers and a rectangular box, container or booklet. The individual papers comprise a curved edge cigarette rolling paper having a longitudinal direction with a rectilinear edge extending in the longitudinal direction and a curved edge opposite said rectilinear edge. A crease extends in the longitudinal direction between the curved edge and the rectilinear edge. The paper if folded in half or other ration along the fold. The folded papers are interleaved to form the stack with one set of papers having their rectilinear edge toward the top of the stack above their curved edge and an alternating set of papers having their curved edge toward the top of the stack above their rectilinear edge. A rectangular 6-sided box encloses or contains the stack with a longitudinally extending slot for dispensing one curved edge cigarette rolling paper at a time. The box incudes a cover hinged at a longitudinal corner of the box to overlie the slot in a closed position. One paper is dispensed with its rectilinear edge exiting the box first followed by a subsequent paper dispensed with its curved edge exiting the box first. In other words the stack has the same type of papers, but the orientation of the papers alternates from paper-to-paper. Accordingly, each paper with its curved edge leading, is disposed between two papers with their rectilinear edges leading. Leading means the edge on top of the stack, i.e. the edge which first exits the slot. By corollary, each paper with its rectilinear edge leading, is disposed between two papers with their curved edges leading.

A strip of adhesive is applied adjacent the rectilinear edge of each paper. The strip of adhesive is disposed on an inside of the folded paper. In other words, when the paper is folded the adhesive will be internal, facing the curved edge. Accordingly, the strip of adhesive is oriented toward the top for the one set of papers (with the rectilinear edge leading), and wherein said strip of adhesive is oriented away from the top for the alternating set of papers (with the curved edge leading). The curved edge of the one set of papers draws out the subsequent paper, and the rectilinear edge of the alternating set of papers draws out the subsequent paper. More specifically, the curved edge of the one set of papers draws out the curved edge of the subsequent paper, and the rectilinear edge of the alternating set of papers draws out the rectilinear edge of the subsequent paper.

The cover includes a curved free end opposite the hinge. The cover free end curve is the same dimension as the curved edge of the paper. The cover free end curve overlies the curved edge of one of the alternating set of papers as it partially exits the slot. The cover is the same dimension as a portion of a paper between said crease and said curved edge.

Each paper includes a curved section width extending from the crease along the middle of the paper to the highest point of the curve. The cover width extends from the hinge at the longitudinal corner of box along the middle of the cover to the highest point on the free end thereof. The curved section width is the same as the cover width. Each paper includes a rectangular section width extending from the crease along the middle of the paper to the rectilinear edge. The rectangular section width is the same as the curved section width.

The rectangular box includes a box width extending perpendicular to the longitudinal direction. The box width is 0.1 to 4 mm larger than said curved section width. In a closed position the cover free end curve is coextensive with the curved edge of a rolling paper partially exiting the box. The periphery of the rectangular box has the same shape and fold location as the paper. The periphery or footprint of the rectangular box is about 0.1 mm to 4 mm larger than the paper. More specifically, the internal box dimensions are about 1 mm to 3 mm larger than the paper. In a closed position a portion of the cover adjacent the cover hinge overlies the rectangular section of the paper from the one set.

BRIEF DESCRIPTION OF THE DRAWINGS

The advantages, nature, and various additional features of the invention will appear more fully upon consideration of the illustrative embodiments now to be described in detail in connection with accompanying drawings. In the drawings wherein like reference numerals denote similar components throughout the views.

DETAILED DESCRIPTION OF THE PREFERRED EMBODIMENTS

Figure 1:
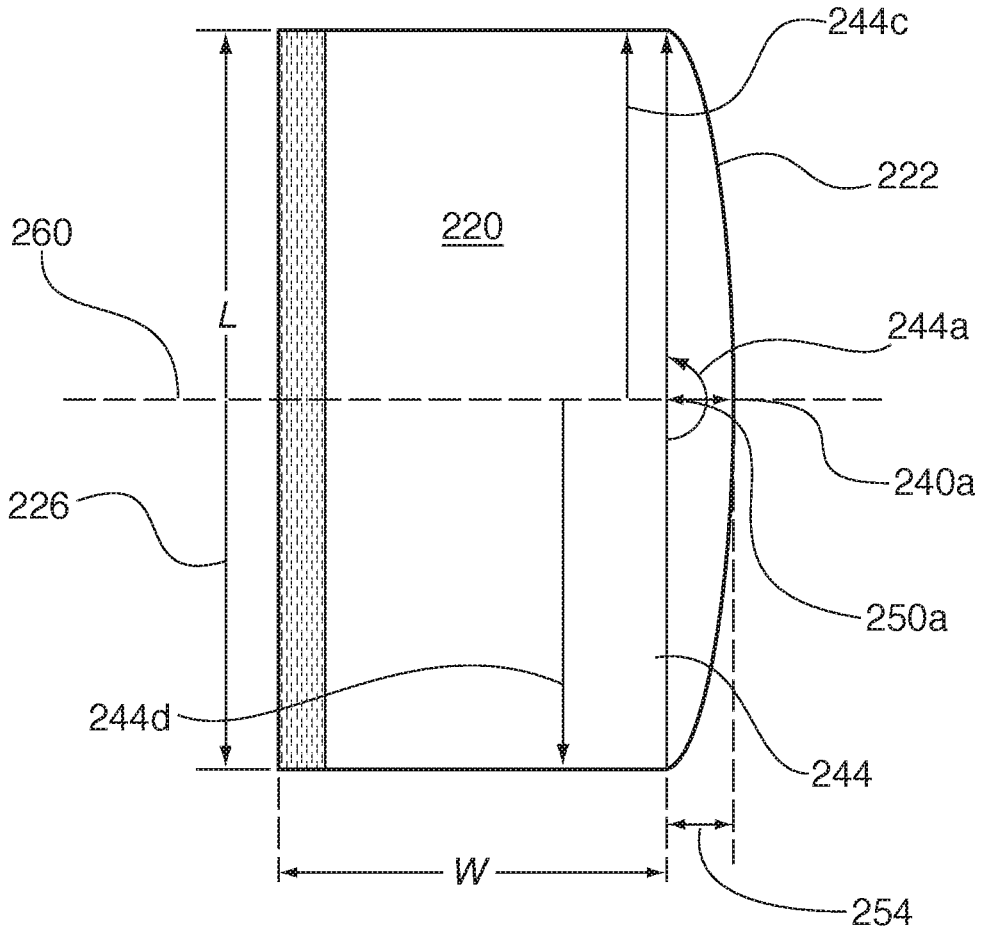
FIG. 1 is a schematic drawing showing the relationships between the elliptical arc and the paper.

FIG. 1 is a diagram of the curved edge cigarette rolling papers utilized in the interleaved package according to the invention. It illustrates the section above arch width 244 to top 240*a* as comprising the curved edge 222 of paper 220. Curved edge 222 represents the bottom of the paper where the tobacco is placed and the rolling process begins. The left side of paper 220 optionally includes adhesive 226 to seal the cigarette once the rolling process is complete. A minor axis segment 250*a*, which represents the largest dimension of the curve is located in the center of paper 220. More particularly, minor axis segment 250*a* extends collinear to line 260 which represents an axis of symmetry for paper 220. In other words, if paper 220 is folded along line 260, the two halves will have an identical shape. It is axiomatic that the central angle 244*a* of the arch width 244 is 180 degrees. The first arch width segment 244*c* extending orthogonal from line 260 to the top edge of paper is equal in length to the second arch width segment 244*d* extending orthogonal from line 260 to the opposite bottom edge of paper 220.

Paper 220 includes a width W. The curved edge is a section from an ellipse. The ellipse includes a major axis. The major axis 242 has a length that is between 1 and 10 times longer than width W. Note the relationship of width W is in comparison to the major axis, even when a narrower arch width is used on the actual paper. Ellipses may be selected from the group having a major axis that is between 2 and 10 time the length of the minor axis. The region between the elliptical arc 222 and the first and third rectilinear sides may have a smooth rounded transition which may be slope shaped. This rounded transition may have a curvature different than the central portion of the elliptical arc.

Paper 220 includes a length L. In general, the length L will be greater than the width W. At the shortest, assume W is five units in width, and the paper will be rolled one and one-quarter revolutions, with one revolution taking up four units. The resulting cigarette will have a circumference of 4 units, with a one unit overlap. Arch height 254, following the formula of ¼ the circumference, would be 1 unit long, or ⅕ of width W. At the longest, assume W is eight units in width, and the paper will be rolled two complete revolutions, with each revolution taking up four units. The resulting cigarette will have a double wall and a circumference of 4 units. Arch height 254, following the formula of ¼ the circumference, would be 1 unit long. Accordingly, arch height 254 will be between ⅕ and ⅛ of width W. The arch height 254 is also referred to as the curve deflection.

This invention relates to the configuration of a rolling paper, and can be applied to rolling papers of any type. By way of example only, rolling papers are made from cellulose, plant fibers, rice, flax, hemp and tobacco. When made from cellulose, a synthetic or natural polymer may be selected. Several patents disclose the composition of rolling papers as follows: U.S. Pat. Nos. 5,060,675 and 5,450,862 and 5,878,754 and 6,138,684 and 8,701,681 the contents of which are incorporated herein by reference thereto. Rolling papers have a thickness on the order of several millimeters, or less than one millimeter, for example between 0.025 and 0.0025 mm. The rolling papers may be manufactured in a sheet or web of indefinite length. The rolling papers may be cut from the web by die-cutting, stamping or any other suitable means. The length L can range between about 60 mm and about 100 mm, and the width W can range between about 35 mm and about 45 mm. The curved edge can be formed by trimming a rectangular paper.

Figure 2:
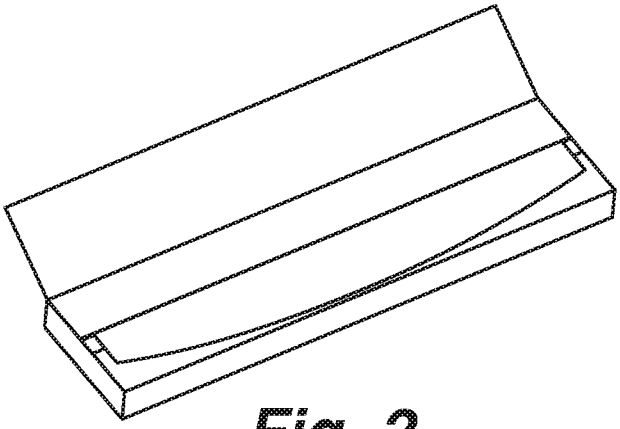
FIG. 2 is a perspective view of the packaged interleaved curved edge cigarette rolling papers.
Figure 3:
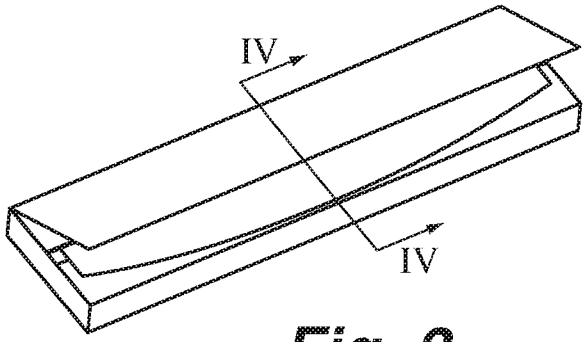
FIG. 3 is an alternate perspective view of the packaged interleaved curved edge cigarette rolling papers.

FIGS. 2 and 3 show examples of packaging that is used in the distribution and sale of many types of rolling papers, containing the novel curved edge rolling papers. The packaging is a cardboard box with a lid covering a slit that is formed in the top of the box. The top rolling paper exits the slit. Upon removing the top rolling paper, the interleave draws the leading edge of the next paper out through the slot.

Figure 4:
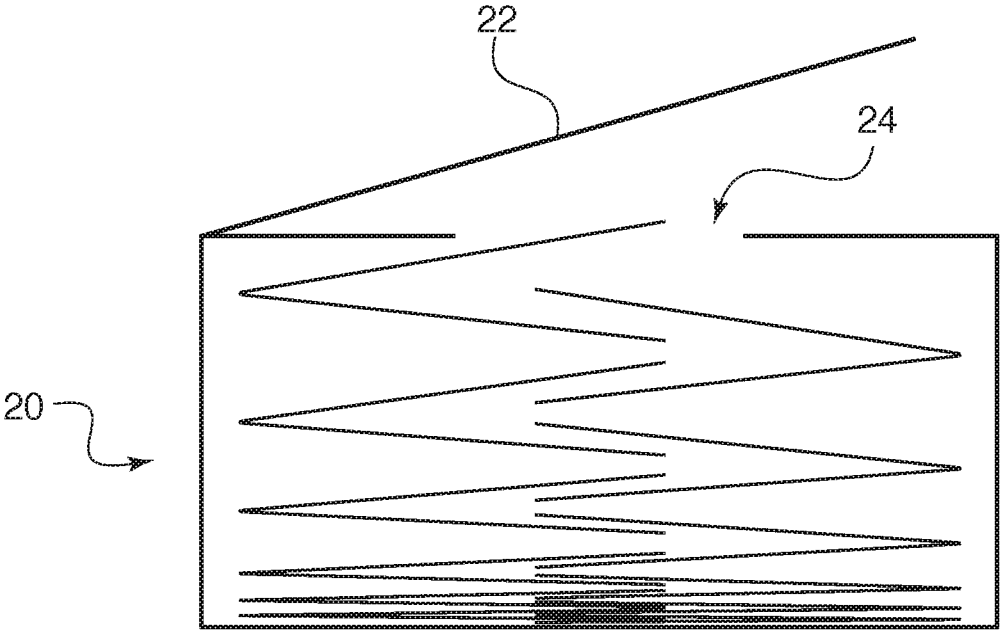
FIG. 4 is an enlarged cross-sectional view of the package, taken along the line IV-IV from FIG. 3.

FIG. 4 shows in cross-section the box 20 and the lid 22 which is attached via a creased fold along one long end of box 20. The top surface of the box features a slit 24 that extends about ¼ to about ⅓ of the width of the box, and about the full length of the box.

Figure 5:
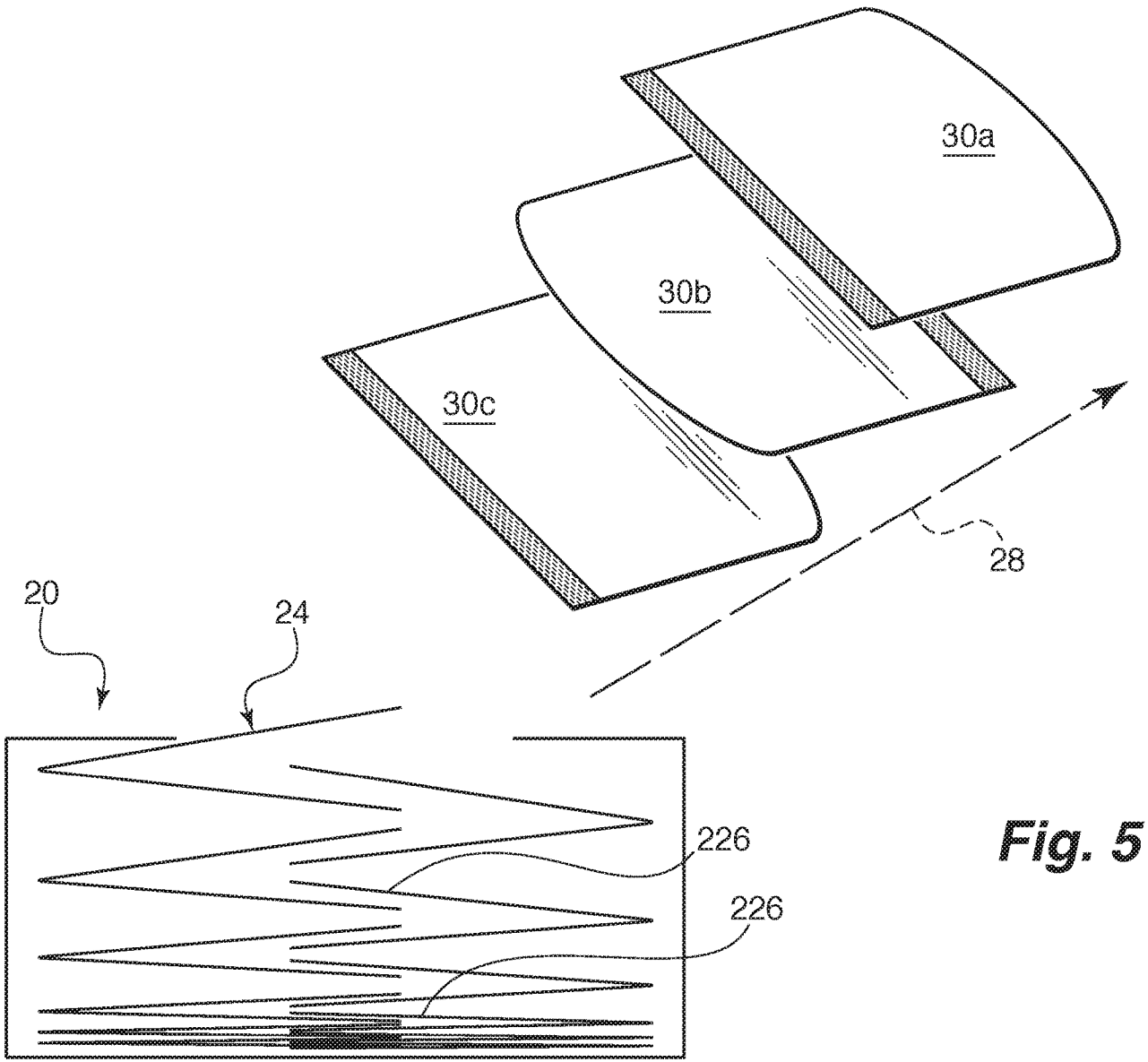
FIG. 5 is a perspective view illustrating a series of curved edge cigarette rolling papers being dispensed from the interleaved package.

FIG. 5 show box 20 with lid 22 removed for the sake of clarity. The top rolling paper is withdrawn from the box in the direction indicated by dotted arrow line 28. As it is pulled from the box, the interleave draws the leading edge of the second paper out through the slit. This process of drawing the next paper is continued until the box is empty of all papers. Withdrawn papers 30*a*, 30*b* and 30*c* illustrate the configuration of the papers as they are sequentially drawn out of the box.

The rolling papers may be provided with a strip of adhesive opposite the curved edge, for example, adhesive 226 shown as a rectangular strip in FIG. 1. When such papers are folded, the adhesive strip would be inside the fold. When such papers are interleaved, the adhesive strip would be on the bottom of the paper. FIG. 5 shows one of the left side papers with adhesive 226 internal of the folded paper, and on the bottom leaf. One of the right side papers also has adhesive strip 226 labeled, which is internal of the folded paper, on the bottom leaf. In this way, the top paper has the curved edge exiting the slit, with the adhesive edge protected within the package.

Figure 6A:
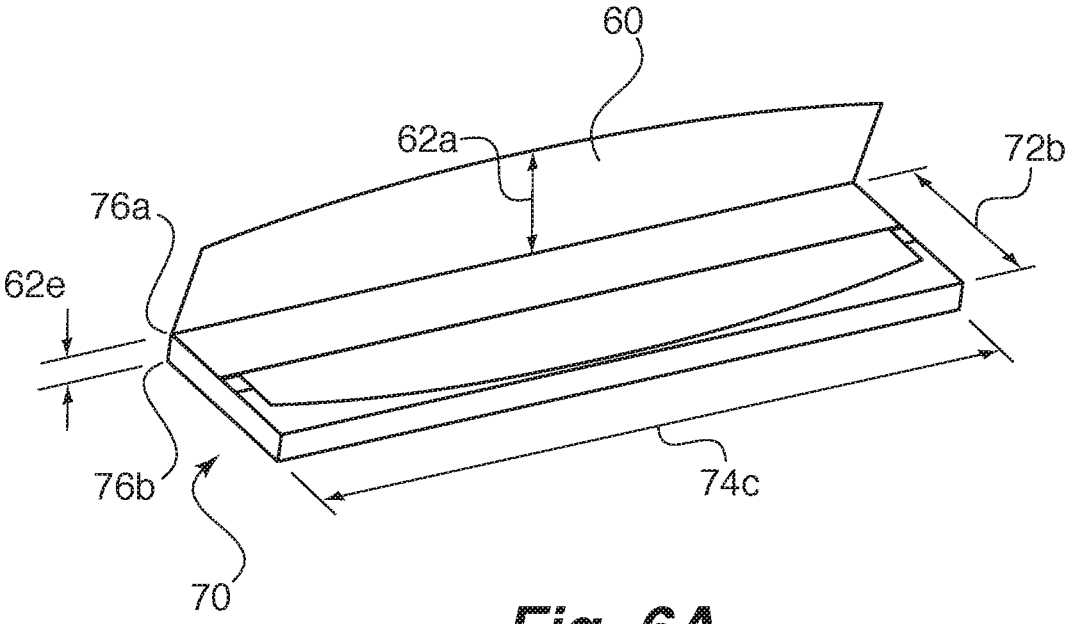
FIGS. 6A and 6B are side-by-side perspective views of the package with a curved lid configuration adjacent a partially folded curved edge cigarette rolling paper.
Figure 6B:
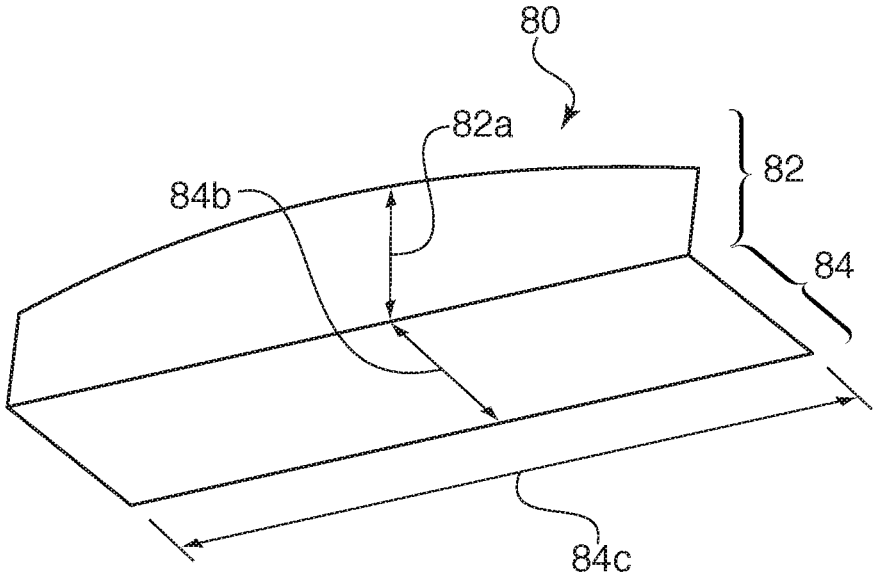

In FIGS. 2 and 3 the lid is rectangular with similar dimensions to the box length and width. In FIG. 6A there is shown a box 70 is shown with a curved edge cover 60. Adjacent is FIG. 6B showing a curved edge rolling paper 80 partially folded. The portion above the fold constitutes curved section 82 while the portion below the fold constitutes rectangular section 84. Curved section 82 has a curved section width 82*a* and rectangular section 82 has a rectangular section width 84*b*. The curved section width 82*a* is the same as rectangular section width 84*b* providing a compact stack and resulting package. The fold may be adjusted to have curved section width 82*a* be greater or smaller than rectangular section width 84*b*.

Cover 60 has a cover width 62*a* which is the same dimension as curved section width 82*a*. Box 70 has a box width 72*b* which is slightly larger than rectangular section width 84*b*. More particularly, box width 72*b* is 0.1 mm to 4.0 mm larger than rectangular section width 84*b*. The larger box width dimensions is to provide an internal volume that can contain the rolling paper stack with a slight excess of space so that individual papers can be dispensed without undue friction from the box sides.

Cover 60 and box 70 have a length 74*c* which is slightly larger than rectangular section length 84*c*. More particularly, cover 60 and box 70 have a length 74*c* which is 0.1 to 4.0 mm larger than rectangular section length 84*c*. The larger box length dimension is to provide an internal volume that can contain the rolling paper stack with a slight excess of space so that individual papers can be dispensed without undue friction from the box sides.

Figure 7:
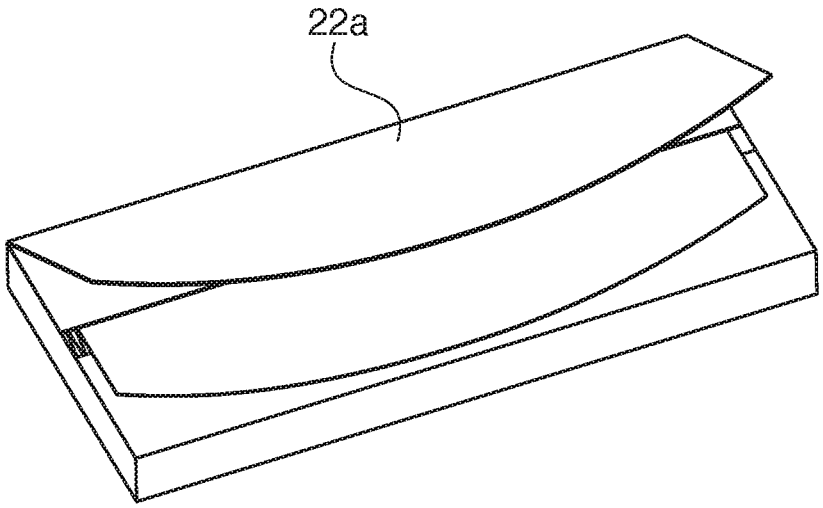
FIG. 7 is an alternate perspective view of the packaged interleaved curved edge cigarette rolling papers with curved lid.

In one embodiment, cover 60 is hinged to upper box corner 76*a*. In an alternate embodiment cover 60 is hinged to lower box corner 76*b*. In this instance, cover 60 includes a cover extension 62*e*, that extends from the upper box corner 76*a* to the lower box corner 76*b*. Cover width 62*a* is always measured from the free end to the upper box corner 76*a*. In other words, cover width 62*a* does not include additional dimensions when cover extension is present. Accordingly, cover width 62*a* is the same as curved section width 82*a* whether a cover extension is present or not. FIG. 6A shows a rolling paper exiting the box slot with its curved edge first. When the cover closes, as shown in FIG. 7, the curved free end of the cover will completely overlie the curved edge of the exiting rolling paper. The free end of the cover has a arc shape that is the same dimensions and geometry as the curved edge of the rolling paper. The curved free end of the cover and the curved edge of the rolling paper are coextensive.

Having described preferred embodiments for (which are intended to be illustrative and not limiting), it is noted that modifications and variations can be made by persons skilled in the art in light of the above teachings. The curved edge can be of various geometries as long as the central portion is longer than the end portions. Oval or elliptical shapes are ideally suited, but other regular, irregular or compound curves may be employed as long as the transition between the curved edge and the rectilinear side edges is smooth without sharp corners. The use of any rolling paper material, composition and manufacturing methods are intended to be included within the scope of the invention. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A pop-up dispenser for curved edge cigarette rolling papers comprising:

a stack of papers having a top wherein each paper includes:

a curved edge cigarette rolling paper having a longitudinal direction with a rectilinear edge extending in the longitudinal direction and a curved edge opposite said rectilinear edge, a crease extending in the longitudinal direction between said curved edge and said rectilinear edge along which the paper is folded, wherein each paper includes a curved section width extending from the crease to a furthest point on the curved edge in a direction perpendicular to the longitudinal direction, wherein each paper includes a rectangular section between the crease and the rectilinear edge and a rectangular section width extending from the crease along the middle of the paper to the rectilinear edge, and wherein said rectangular section width is the same as said curved section width;

wherein the folded papers are interleaved to form said stack with one set of papers having their rectilinear edge toward the top of said stack above their curved edge and an alternating set of papers having their curved edge toward the top of said stack above their rectilinear edge; and a rectangular box containing said stack with a longitudinally extending slot for dispensing one curved edge cigarette rolling paper at a time and a cover hinged at a longitudinal edge of the box to overlie the slot in a closed position, wherein said cover includes a curved free end opposite the hinge and a cover width extending from the hinge at the longitudinal edge of the box to a furthest point on the curved free end in a direction perpendicular to the longitudinal direction, and wherein the curved section width is the same as the cover width, wherein said cover curved free end has the same curvature as the curved edge of the paper, wherein said rectangular box includes a box width extending perpendicular to the longitudinal direction, and wherein said box width is 0.1 to 4 mm larger than said curved section width, wherein one paper is dispensed with its rectilinear edge exiting the box first followed by a subsequent paper dispensed with its curved edge exiting the box first.

2. The pop-up dispenser of claim 1, further comprising a strip of adhesive applied adjacent the rectilinear edge of each paper.

3. The pop-up dispenser of claim 2, wherein said strip of adhesive is disposed on an inside of the folded paper.

4. The pop-up dispenser of claim 3, wherein said strip of adhesive is oriented away from the top for the one set of papers, and wherein said strip of adhesive is oriented toward the top for the alternating set of papers.

5. The pop-up dispenser of claim 1, wherein the curved edge of the one set of papers draws out the subsequent paper, and wherein the rectilinear edge of the alternating set of papers draws out the subsequent paper.

6. The pop-up dispenser of claim 1, wherein the curved edge of the one set of papers draws out the curved edge of the subsequent paper, and wherein the rectilinear edge of the alternating set of papers draws out the rectilinear edge of the subsequent paper.

7. The pop-up dispenser of claim 6, wherein said cover free end curve overlies the curved edge of one of the alternating set of papers as it partially exits the slot.

8. The pop-up dispenser of claim 7, wherein said cover width is the same dimension as a portion of a paper between said crease and said curved edge.

9. The pop-up dispenser of claim 6, wherein said cover free end curve overlies the curved edge of one of the alternating set of papers as it partially exits the slot.

10. The pop-up dispenser of claim 1, wherein in a closed position said cover free end curve is coextensive with the curved edge of a rolling paper partially exiting the box.

11. The pop-up dispenser of claim 1, wherein in a closed position a portion of said cover adjacent the cover hinge overlies the rectangular section of the paper.

* * * * *